US011419376B2

(12) United States Patent
Turley

(10) Patent No.: US 11,419,376 B2
(45) Date of Patent: Aug. 23, 2022

(54) METHOD FOR ATTACHING HAIR EXTENSIONS

(71) Applicant: McKenzie Turley, St. George, UT (US)

(72) Inventor: McKenzie Turley, St. George, UT (US)

( * ) Notice: Subject to any disclaimer, the term of this patent is extended or adjusted under 35 U.S.C. 154(b) by 0 days.

(21) Appl. No.: 17/011,323

(22) Filed: Sep. 3, 2020

(65) Prior Publication Data

US 2021/0059337 A1 Mar. 4, 2021

Related U.S. Application Data

(60) Provisional application No. 62/895,457, filed on Sep. 3, 2019.

(51) Int. Cl.
*A41G 5/00* (2006.01)

(52) U.S. Cl.
CPC ..... *A41G 5/0073* (2013.01); *A41G 5/0053* (2013.01)

(58) Field of Classification Search
CPC ..... A41G 5/00; A41G 5/0013; A41G 5/002; A41G 5/0026; A41G 5/0033; A41G 5/004; A41G 5/0046; A41G 5/0053; A41G 5/006; A41G 5/0006; A41G 5/0066; A41G 5/0073; A41G 5/008; A41G 5/0086; A41G 3/00; A41G 3/0008; A41G 3/00126; A41G 3/0025; A41G 3/0033; A45D 2007/002; A45D 2007/004
USPC ..... 132/200, 201, 53, 54, 55; D28/25
See application file for complete search history.

(56) References Cited

U.S. PATENT DOCUMENTS

| | | | | |
|---|---|---|---|---|
| 5,107,867 | A | 4/1992 | Barrington | |
| 5,121,761 | A * | 6/1992 | Meister | A41G 5/0053 132/201 |
| 5,881,737 | A | 3/1999 | Nelson | |
| 6,253,771 | B1 * | 7/2001 | McClaine | A45D 24/10 132/148 |
| 7,343,921 | B2 | 3/2008 | Salinas | |
| D596,325 | S * | 7/2009 | Germano-Cataldo | D26/39 |
| 7,661,434 | B2 | 2/2010 | Frazier | |

(Continued)

FOREIGN PATENT DOCUMENTS

| | | | |
|---|---|---|---|
| AU | 2007241692 | B2 | 11/2007 |
| WO | 2008005037 | A1 | 1/2008 |

OTHER PUBLICATIONS

Eres Hermosa, https://www.youtube.com/watch?v=HnHgoEiGa4o, Aug. 1, 2016 (Year: 2016).*

(Continued)

*Primary Examiner* — Tatiana L Nobrega
*Assistant Examiner* — Sarah Woodhouse
(74) *Attorney, Agent, or Firm* — Gurr Brande & Spendlove, PLLC; Robert Dan Spendlove

(57) ABSTRACT

A method of attaching hair extensions includes sectioning, beading, securing, and stitching hair extensions into a client's hair. Sectioning allows a hairdresser to properly place the hair extension, which creates beads that are unseen. The beads may be placed so as to allow a flexible groove to place the wefts. Securing the wefts includes a pattern of stitching that places a stitch at a side, middle, opposite side, and between the beads. This stitching pattern promotes secure wefts as well as prevents damage to scalp and hair.

9 Claims, 17 Drawing Sheets
(17 of 17 Drawing Sheet(s) Filed in Color)

(56) References Cited

U.S. PATENT DOCUMENTS

| | | | | |
|---|---|---|---|---|
| 8,336,559 | B2 | 12/2012 | Kallabat et al. | |
| 9,596,898 | B2 | 3/2017 | Seawright | |
| 2003/0159705 | A1 | 8/2003 | Ferguson | |
| 2005/0061346 | A1 | 3/2005 | Song | |
| 2007/0157944 | A1 | 7/2007 | Catron et al. | |
| 2010/0275940 | A1 | 11/2010 | Kallabat et al. | |
| 2013/0042881 | A1 | 2/2013 | Mutchler | |
| 2013/0167858 | A1 | 7/2013 | Lee | |
| 2014/0060566 | A1* | 3/2014 | Walker | A41G 5/0073 132/201 |
| 2014/0326267 | A1 | 12/2014 | Peterson et al. | |
| 2017/0020218 | A1 | 1/2017 | Kenna | |
| 2019/0357614 | A1* | 11/2019 | Rangel | A41G 5/006 |
| 2020/0113262 | A1* | 4/2020 | Tokko | A41G 5/0066 |
| 2021/0227910 | A1* | 7/2021 | Sawyer | A41G 5/0086 |

OTHER PUBLICATIONS

LA Weave, https://www.youtube.com/watch?v=zj-PNSbpmeo, Aug. 24, 2017 (Year: 2017).*

Jayne Hair Extension Co, Detailed LA Weave Human Hair Extension Application Video and Tutorial, https://www.youtube.com/watch?v=SoH07yCZK2M (Year: 2019).*

Steven Mathew, Invisible Hand Tied Wefts, Aug. 30, 2019, youtube.com, https://www.youtube.com/watch?v=csYiYjwLpms (Year: 2019).*

Ep. 8 Bohyme Hand-Tied Weft Installation, Feb. 25, 2019, Youtube.com, https://www.youtube.com/watch?v=44-ZCSQOgo0 (Year: 2019).*

Alexsis Mae, "I got beaded row extensions", Jan. 18, 2018, youtube, https://www.youtube.com/watch?v=5vxZgukm_ic (Year: 2018).*

* cited by examiner

METHOD FOR ATTACHING HAIR EXTENSIONS

CROSS-REFERENCE TO RELATED APPLICATIONS

This application claims the benefit of U.S. Provisional Application Ser. No. 62/895,457, filed on Sep. 3, 2019, which is incorporated herein by reference.

TECHNICAL FIELD

The present disclosure relates to hair extensions. More particularly, the present invention relates to a novel and nonobvious method for attaching hair extensions.

BACKGROUND

Hair extensions have been used for thousands of years to give volume and beauty to a woman's hair. In fact, ancient Egypt used hair extensions as a tool to create what they deemed to be the most perfect and beautiful look. Also, many of these ancient royals wore hair extensions to show others their place in society. However, people today wear hair extensions for many other reasons. For example, many women wear hair extensions to add density to their hair due to the fact that many women want thicker hair. Additionally, hair extensions allow women to continually change their hair density, color, and length, without having to go through a hair growing process, hair cutting, hair dying, etc., which allows them to have the beauty and look they desire instantly.

Further, while the ancient civilizations may have had hair extensions, the means of attaching the hair extensions have changed drastically. The civilizations of old often used beeswax to attach hair extensions. They also stitched in hair extensions by tying knots into the hair. Today, while hair extensions are still used, they are placed in the hair with different attachment mechanisms. Some of the mechanisms involve hair that is attached to a clip, which allows a woman to place hair extensions quickly and easily in their hair. Other mechanisms may involve beads and strand by strand attachment, while others include taping wefts to sections of a woman's head. Even with the many advancements in hair extension attachment mechanisms, there are still shortcomings found in these means of attachment. For example, taping wefts may shorten application time, but may also not adhere properly if using certain hair products or if they become wet, which will eventually lead to the wefts slipping. Further, other means of attachment may cause the wefts to slip, similar to taping, and are uncomfortable because of tension and weight, which may lead to hair and scalp damage.

Accordingly, there is a need for a hair extension attachment mechanism that does not slip, is comfortable, and prevents damage to the hair and scalp of a woman. The present disclosure seeks to solve these and other problems.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DESCRIPTION OF EXAMPLE EMBODIMENTS

Figure 1:
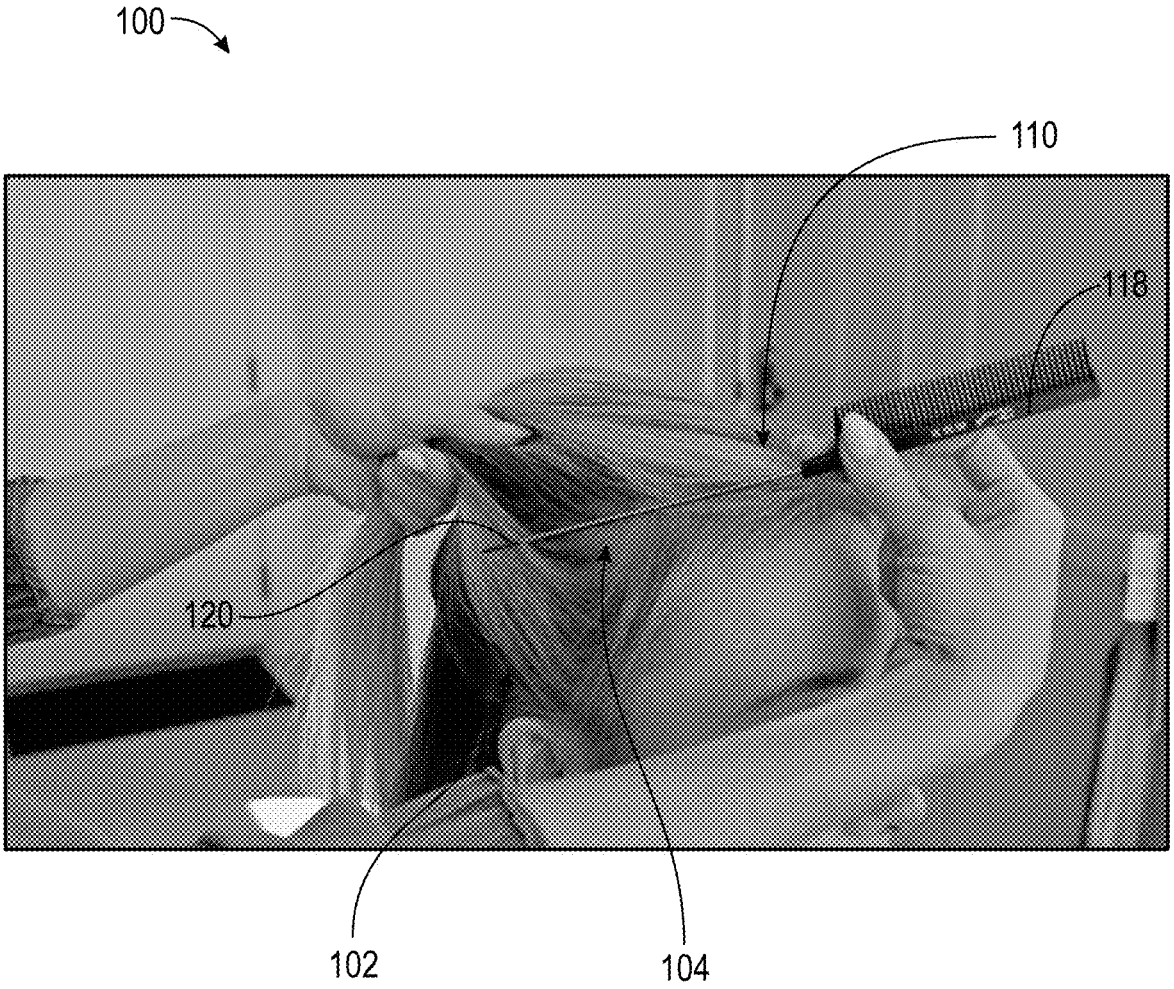
FIG. 1 illustrates a head of a client and sectioning the client's hair.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a hair extension attachment mechanism that does not slip, is comfortable, and prevents damage to the hair and scalp of a woman. The present disclosure seeks to solve these and other problems.

In one embodiment, a method of attaching hair extensions 100 comprises sectioning, beading, and securing and stitching hair extensions into a client's hair. Sectioning allows a hairdresser to properly place the hair extension, which creates beads that are unseen and even in the way that they move and flow. When it comes to sectioning, each hairdresser may approach a client's hairline differently due to different hairlines, hair types, head shape, etc. To start, a hairdresser should understand hairlines and check the client's hairline by checking along the front of a client's head. The hairdresser then seeks out the points of recession on the client's hair. It should be noted that points of recession may vary from client to client. These points of recession are sought so as to avoid parting/sectioning the client's hair in those areas. If a section begins too far forward on the client's head, then when the client pulls up their hair, the hair extensions will be visible.

Figure 2:
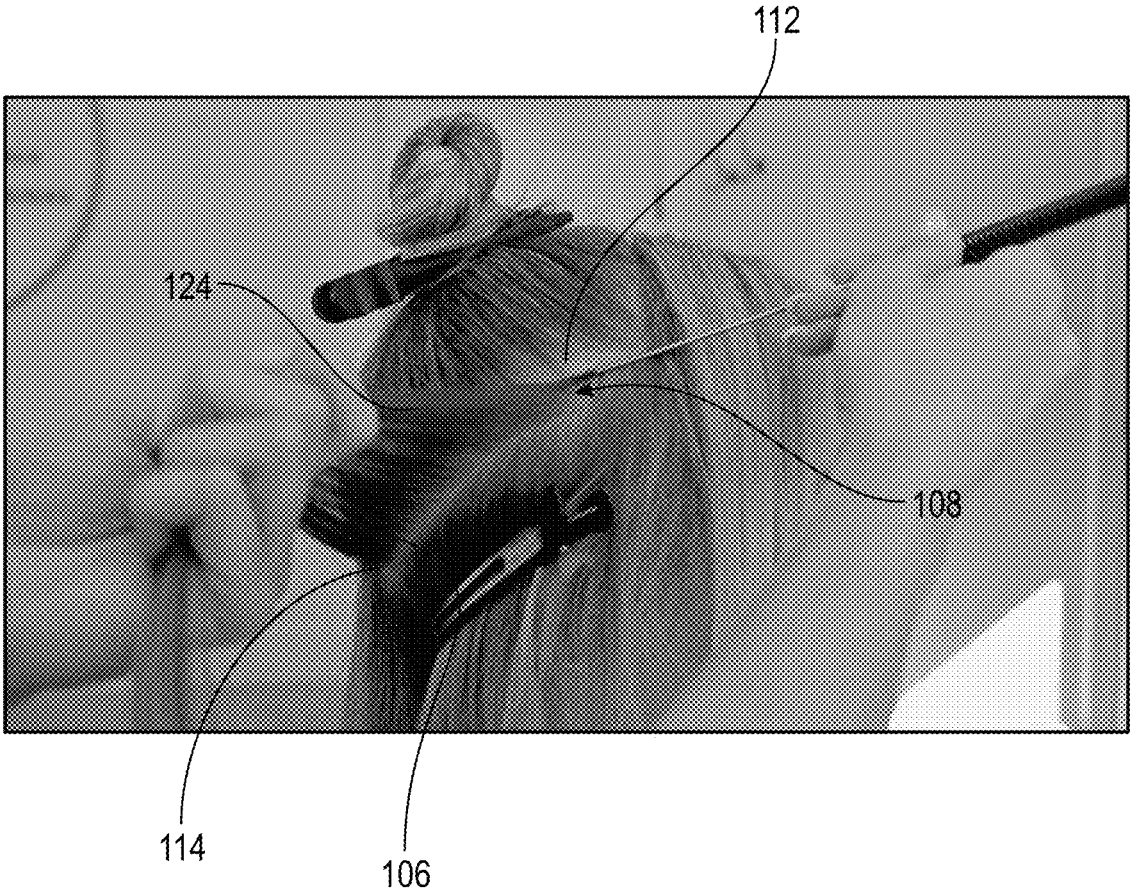
FIG. 2 illustrates a first and a second row sectioned by a hair separator.

As shown in FIG. 1-2, in order to avoid exposing the extensions, the hairdresser may utilize a three-point check system for sectioning the client's hair. First, the hairdresser checks coverage above the ear, at an ear area 102, which may ensure that when a client's hair is pulled up, the extensions are covered. Second, the hairdresser checks the hairline around the face and identifies a recession point 104. In other words, the hairdresser checks the hairline based upon the client's hair density. Typically, the client's recession may be about a three-finger width in from their frontal hairline. However, it will be appreciated that some clients may have recessions closer to or farther away from the frontal hairline than the three-finger width. Once the recession is determined, a bottom row 106 of a first section 108 may start behind the recession point 104. In one embodiment, the bottom row 106 begins an inch behind the recessions point 104. Third, the hairdresser checks hair extension coverage from the client's typical part line 110 based on hair density. At times, the third step may be unnecessary because the second step may show a hairdresser where the recession point is located and where sectioning should begin.

Once the hairdresser has performed the three-point system check on the front of the hairlines and part lines above the ear, the hairdresser may section a portion of natural hair at the occipital. It should be noted that client's with thin hair should receive a sectioning below the parietal ridge. Alternatively, if a client has a blunt, thick bob, the hairdresser should section below where the occipital starts to round, which allows the hairdresser to break up the dense hair. The hairdresser may section longer hair right at the occipital, just as the head starts to round in the back, which creates a placement for the bottom row 106. After the hairdresser sections the client's hair, coverage should be checked by lifting the client's hair to make sure that the bottom row 106 is covered when a woman would put her hair in a ponytail. This may vary based upon a client's hair density.

Oftentimes when the hairdresser sections, the client may have fine hairs, new growth, and/or broken off hair that will need to be removed from the bottom row 106 and a top row 112 of the first section 108 so as to create a clean, unobstructed hair extension parting. It will be appreciated that clean rows allow a hairdresser to proceed in the hair extension process without barriers. To clean a parting, the hairdresser may use, for example, a mister spray bottle, hairspray, or any other means of moving the fine hairs from the bottom and top rows 106, 112. After the rows 106, 112 are cleaned around the client's head, the hairdresser may check to ensure the bottom row 106 is parallel from one side of the client's head to the other.

Figure 3:
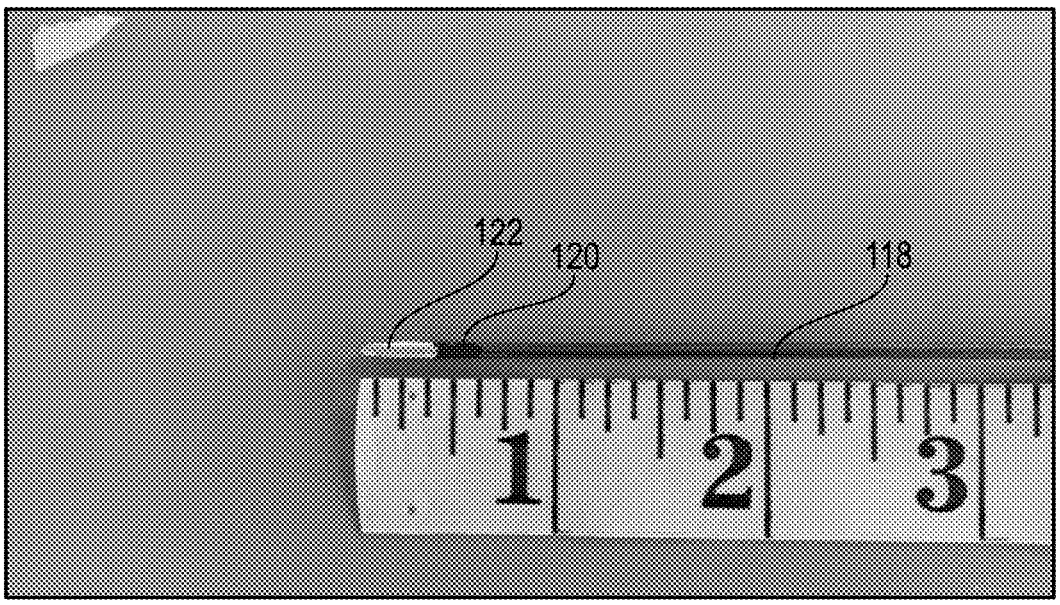
FIG. 3 illustrates a first and a second measurement of a hair separator.
Figure 4:
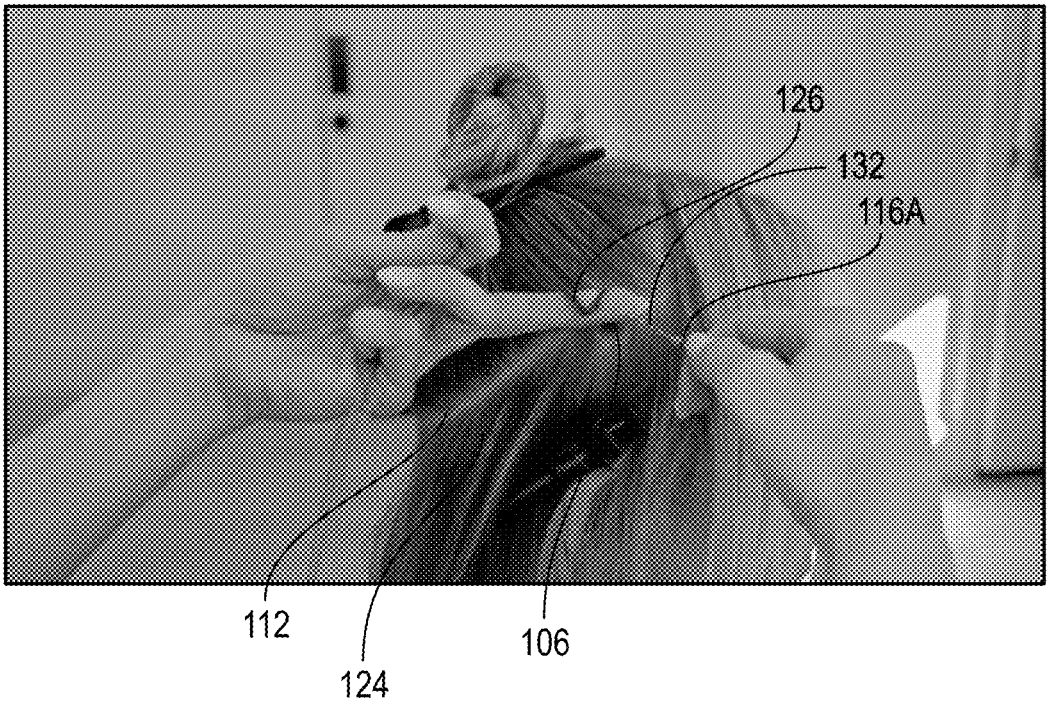
FIG. 4 illustrates a bead placed on a bead dropdown section.
Figure 5:
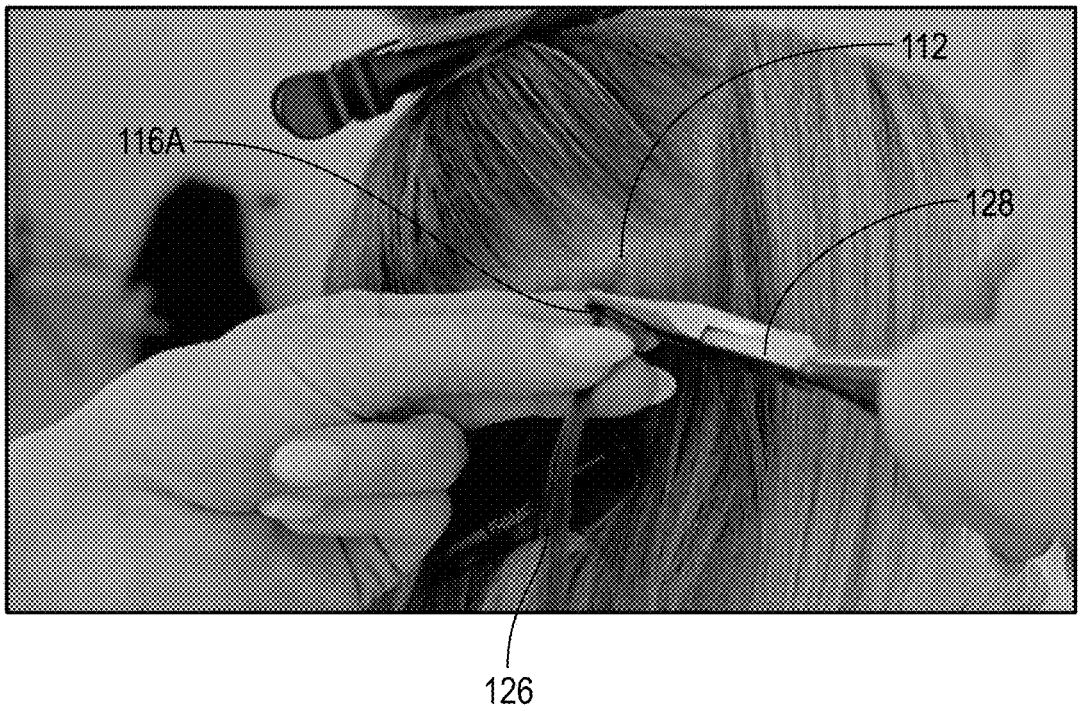
FIG. 5 illustrates a bead crimped on a bead dropdown section.
Figure 6:
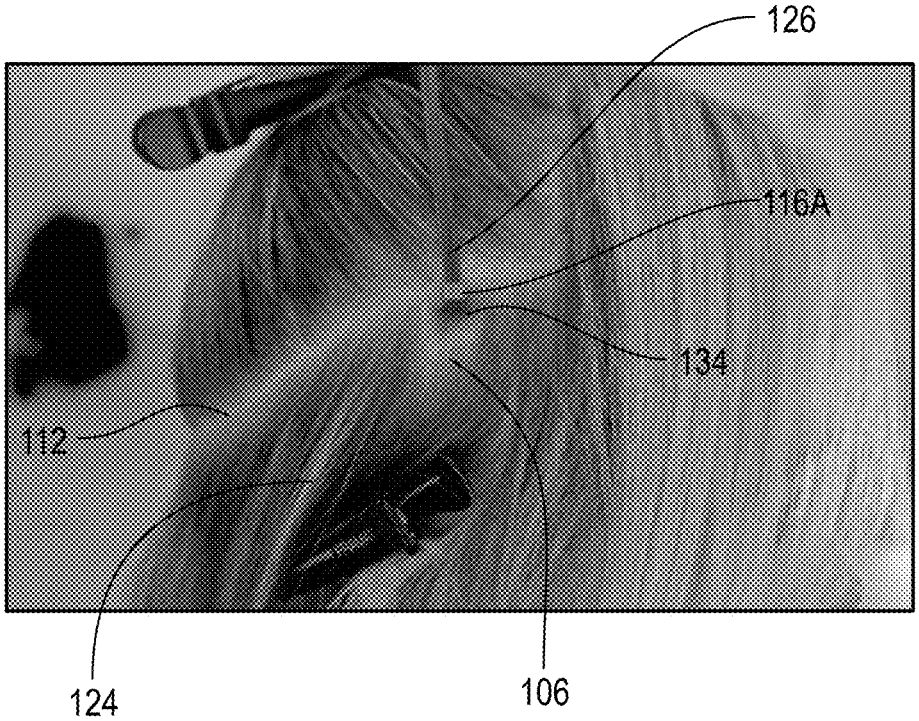
FIG. 6 illustrates a flexible groove under a bead on a bottom row.
Figure 7:
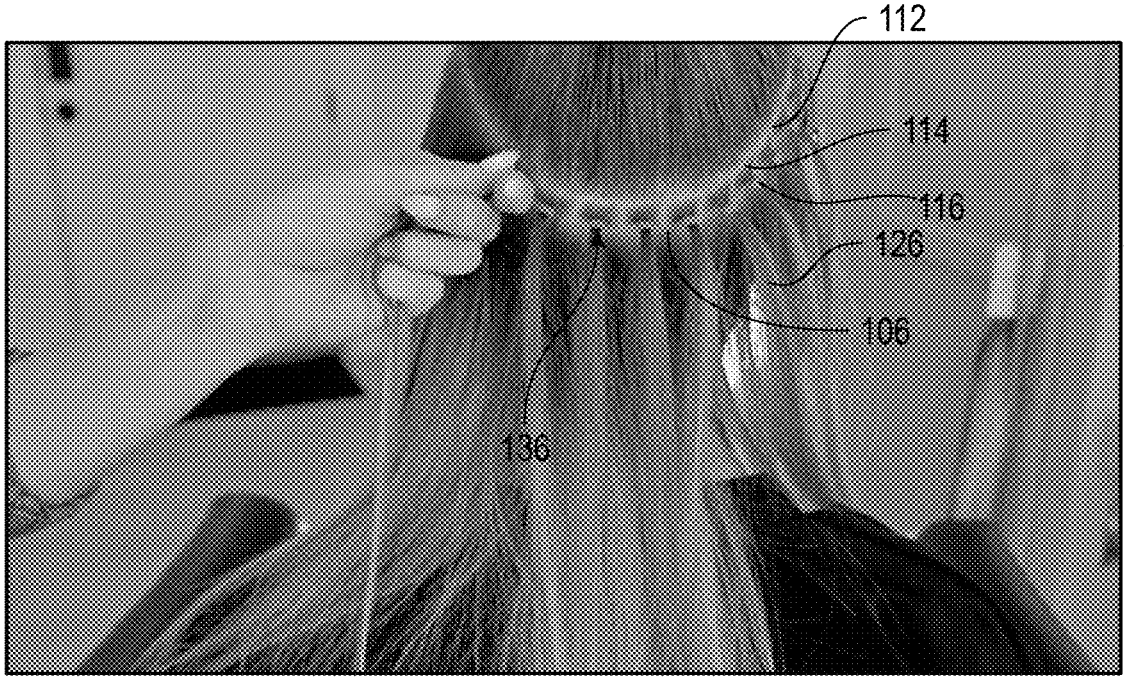
FIG. 7 illustrates a plurality of beads crimped to bead drop down sections.

Referring to FIGS. 2-3, after sectioning is completed for the bottom row 106 of the first section 108, a horseshoe pattern 114, which may be a deep horseshoe pattern, following the curvature of the client's head is created, and a plurality of beads 116 may be placed in the hair. The hairdresser may use, in some embodiments, a hair separator 118, such as a tail comb, with a first measurement 120 to measure the size of the sections from side to side, which is the width. The hair separator 118 may also have a second measurement 122 to establish the size of the section from top row to bottom row, the depth or a dropout section 124. For example, in one embodiment, the hair separator 118 may have the first measurement 120 at ⅝" to measure the width of the section while the second measurement may be at ⅜" to measure the depth of a section. The hairdresser may measure the dropout section 124 by placing the hair separator 118 at the bottom row and then starting the top row at the depth mark and through another portion of natural hair. The ⅜" and ⅝" markings on the hair separator 118 may be a line measurement marking, colored marking, etc. However, it will be understood that other tools may be used to make the same measurements, such as a ruler. Further, while ⅜" and ⅝" measurements are described, it could be envisioned that other measurements may be used.

When placing the beads 116, the hair should be at a natural fall position, which may keep a client's hair healthier. If hair is not in a natural fall position and a bead dropout section 126 of the dropout section 124 is too large, then the scalp may turn white, meaning that there is a lack of blood flow to that area. Sections that are around, for example, ⅝" may allow the hair, once clamped in the bead 116, to be in the natural fall position.

As shown in FIGS. 4-7, to start the beading process, the hairdresser takes a portion of hair that is above the bottom row 106 (i.e., hair extension parting), which acts as a guide, from the start of the parting until the head starts to round, maintaining a parallel top row 112. The top row 112 is followed to place the bead work. The hairdresser may then check the section depth with the hair separator 118 at the second measurement 122, which is the depth between the top row 112 and the bottom row 106. In some embodiments, the depth is measured at ⅜" with the tail comb. At this point, the hairdresser is only dealing with the dropout 124 (i.e., the hair that has fallen below the top row), where the beads 116 are placed. The hairdresser, in some embodiments, measures a ⅝" section of the dropout, creating the bead dropout sections 126, and separates it from the rest of the dropout 124 to place the bead 116, resulting in a plurality of bead dropout sections after the beading process is completed. In order to place the bead 116, the hairdresser may use, in one embodiment, a set of pliers 128, a hook 130 (e.g., a needle), and threader 132. Further, in one embodiment, the bead used may be a 3 mm silicone lined bead. It will be appreciated that silicone beads may provide a sure grip to the hair so as to remain stationary. While silicone beads are discussed, other beads may be also be used.

After the bead dropout section 126 is measured, the bead 116 may be inserted thereon. The bead 116 may be inserted by using the threader 132. Once the bead 116 is on, it may be placed at ⅓ of the way on base from the bottom and not directly on the client's scalp. If the bead 116 is placed on the scalp, it may become uncomfortable for the client and unhealthy for the hair due to the hair being pulled, creating a lack of blood supply. Flexibility of the section 126 with the bead 116 may also be lost depending on the placement of the bead. For example, a bead that is placed directly on base may force the hair out away from the scalp, creating an unworkable protrusion of hair. There should be a flexible groove 134 between the scalp and each of the beads 116. The flexible groove 134 may be created when the bead does not touch the client's scalp. In fact, the flexible groove 134 creates a space where hair extensions can be positioned. It will be appreciated that the beads are placed away from the scalp so that stitching may be used to secure the hair extensions to the client. In certain embodiments, a width of the flexible groove, as measured from the scalp to the bead 116, may be between 1 and 5 mm. Preferably, the groove width may be between 2 and 4 mm and more preferably 3 mm.

The beads 116 may then be clamped to each of the bead dropout sections 126. To do this, the hairdresser may stabilize the section of dropout hair 124 with their non-dominant hand. This hand may be stabilized against the client's scalp. Once the flexible groove 134 is created, the hairdresser may approach, for example, at a 45 degree angle and clamp the bead 116 with the set of pliers 128. If done correctly, the bead dropout section 126 should fold over and create the flexible groove 134. This process will be repeated until the hairdresser goes around the head of the client and each of the bead dropout sections 126 has a bead Accordingly, as described above, when placing the bead 116, the hairdresser should maintain the flexible groove 134 under the bead 116 and clamp the bead 116 close to, for example, the 45 degree angle.

As the hairdresser moves around the head, problems may arise if the hairdresser changes the position of the clamped beads 116. It may be common to secure beads 116 in varying positions while moving around the head due to the hairdresser not adjusting body position to match the horseshoe pattern 114. In other words, the bead positions will lower at the back of the head, so the hairdresser should maintain consistent bead placement.

Figure 8:
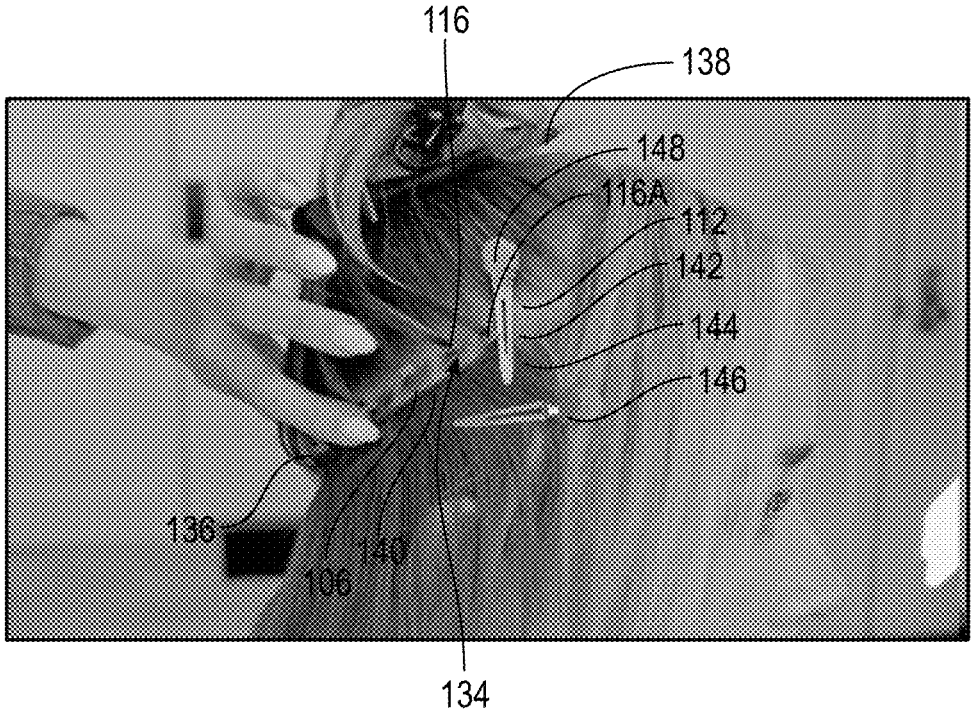
FIG. 8 illustrates a bottom weft coupled to a client's hair.

As shown in FIG. 8, once all of the beads 116 are placed, a beaded track 136, comprising a first bead, a last bead and a plurality of middle beads, is created and ready to receive wefts. Embodiments of the method contemplate the use of hand tied wefts, machine tied wefts, flat wefts, deconstructed volume wefts, or other wefts as would be appropriate in accordance with the knowledge of one of ordinary skill in the art. At times, the wefts are coiled and need to be flattened. Wefts may be flattened by running a hot iron over the weft. To secure the wefts to the client, the hairdresser gathers the dropout sections 126, which were separated by the beads 116, and uses a top clip 138 to clip them to the top of the user's head. A bottom weft 140 may be placed in the flexible grooves 134 on the bottom row 106 of the first section 108. In certain embodiments, the bottom weft 140 is placed in the flexible grooves 134 such that a top end of the weft 140 is positioned between the beads 116 and the scalp or natural hair when the dropout sections 126 are let down. In this manner, the weft 140 may be placed such that the beads 116 come in contact with the bottom weft 140 rather than with the client's scalp or natural hair. In addition, the weft may be placed in this manner such that the beads are not visible when the weft and natural hair are lifted, such as when the hair is placed in a ponytail or other hairstyle requiring lifting of the client's hair. In one embodiment, the bottom weft 140 may be a rooted weft to create a natural look.

The hairdresser then takes the bottom weft 140 and lines it up with an outside edge 142 of the dropout section 124, at a start of the crimped beads 116 and proximate the face of the client. On a first edge 144 of the bottom weft 140, a clamp 146 may be clamped horizontally towards the back of the head below the bottom row 106, securing the bottom weft 140 to the client's natural hair. In one embodiment, the horizontal clamp 146 may be one inch below the bottom row. Another clamp 148 may be placed vertically at a front of the bead proximate the frontal hairline. Further, additional clamps may be placed around the weft 140 below the bottom row 106. While the bottom weft 140 is clamped, equal tension should be maintained, preventing the weft from becoming too baggy or too tight.

At a second edge, opposite the first edge 144, of the bottom weft 140, the bottom weft 140 may be secured to the client via a vertical and horizontal clip 146, 148, similar to the description above of starting the weft securing process with clips. It will be appreciated that additional wefts may be placed over the bottom weft 140 and clipped to the client in a similar manner as the bottom weft 140. The top clip 138 on the top of the client's head may be released, thereby letting the dropout sections 126 fall down. It will be understood that one or more wefts may be attached to a client depending on client hair density and shape of head. For example, really fine haired clients may not be able to handle numerous wefts, such as five or six wefts, on a row. The number of wefts is often determined by the density of the client's hair. When a client has normal to fine density, the client may wear, for example, five wefts on the bottom row 106.

The top row 112 may have less wefts because the top row 112 has a smaller working area than the bottom row 106. The hairdresser may then add a top weft 152 on the top row 112. The top weft 152 is lined up vertically with the previously placed bottom weft 140. The top weft 152 is clamped at a first edge 151 of the top weft with the horizontal and the vertical clips 146, 148. Vertical clips 148 may then be attached around the client's head to secure the top weft 152. This process may be completed numerous times to attach additional top wefts. In some embodiments, centered wefts may be placed on the clients. It will be understood that securing the wefts creates a layer of bottom wefts, the dropout section, and then a layer of top wefts that are prepared to be stitched together.

After the wefts 140, 152 are secured to the client with the horizontal and vertical clips 146, 148, the wefts 140, 152 are then secured via a particular stitching pattern that cinches the wefts around the bead 116, creating a long-lasting effect that conceals the beads 116 used.

Figure 9:
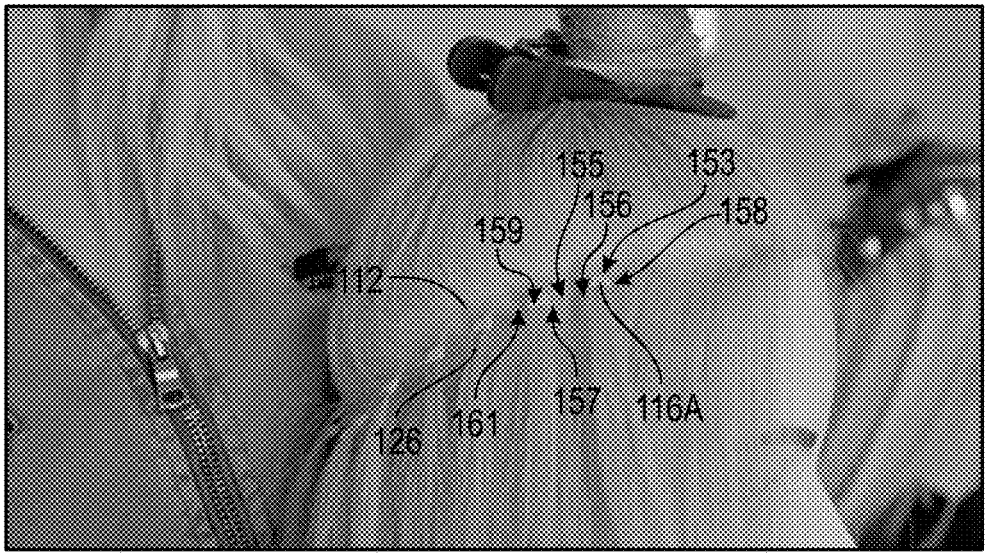
FIG. 9 illustrates placement of various stiches to attach wefts to a client.
Figure 10:
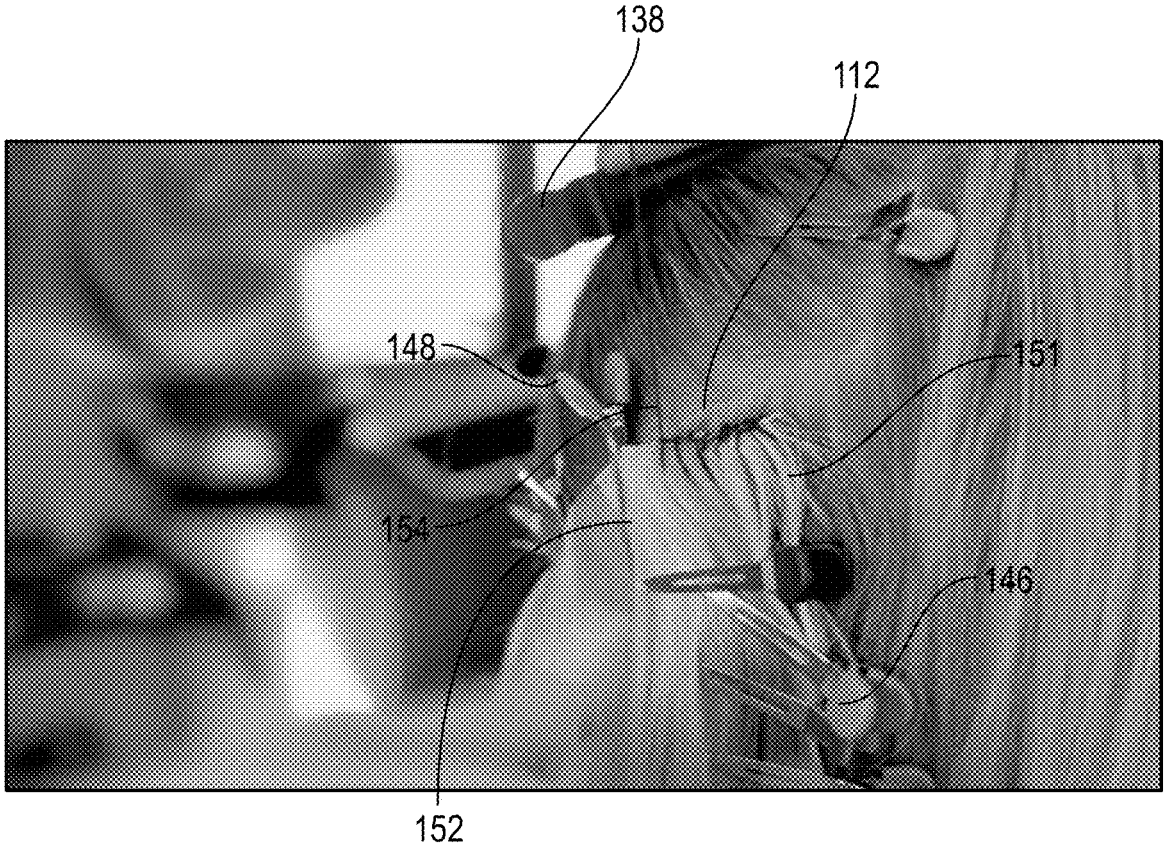
FIG. 10 illustrates a bottom weft and a top weft coupled to a user via cross stitching.
Figure 11:
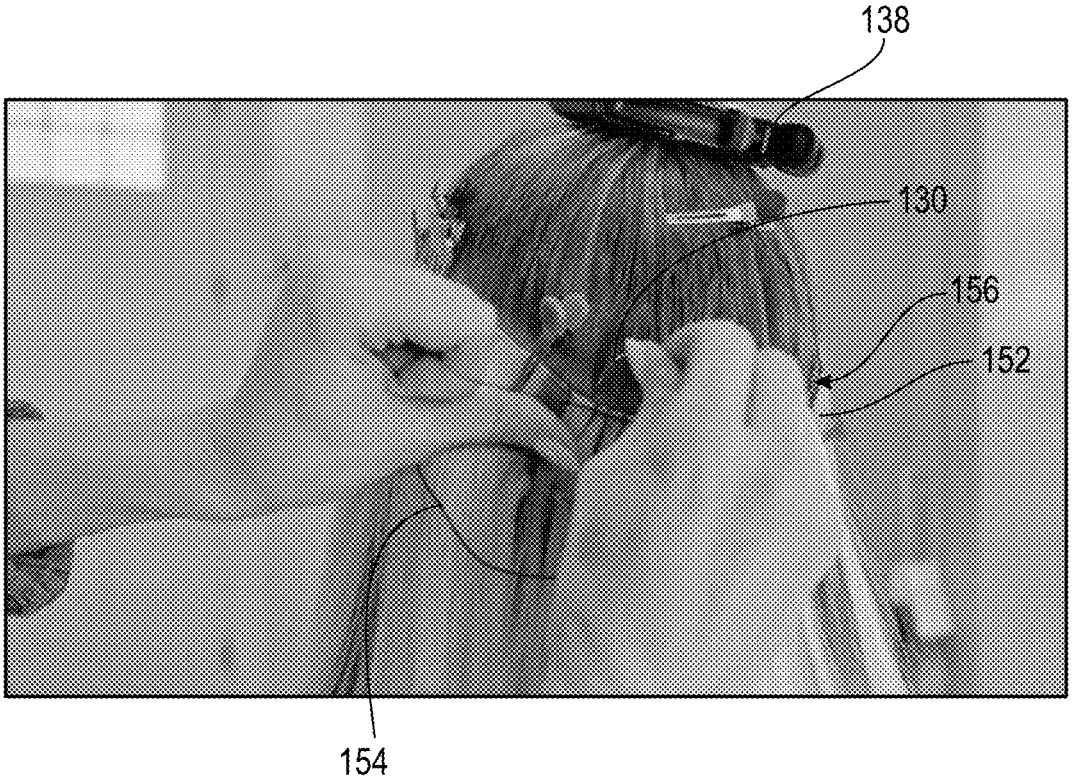
FIG. 11 illustrates a needle and thread coupling a bottom weft and a top weft to a user.

Referring to FIGS. 9-11, to start stitching, the hairdresser takes a thread 154 and the hook 130. The hairdresser may use cotton thread, nylon, or other types of thread to secure the wefts to the client. However, it will be appreciated that cotton thread may provide grip, security, and concealment of the beads that some other types of thread may not provide.

FIG. 9 illustrates the placement of each stitch in the stitching pattern as discussed below. Stitching with a single thread instead of doubling the thread on the client's hair helps provide a seamless look. The hairdresser may make the first knot on an inside 156 of a first bead 116A. Then the thread 154 is tied off twice and the tail is cutoff. Then the hairdresser makes multiple reinforcement stitches (e.g., two to three) on an outside edge 158, opposite the inside edge, of the first bead 116A, ensuring that the wefts 140, 152 lay flat against the client's scalp. Once stitches are placed on the outside edge 158 of the first bead 116A, the hairdresser then places a first bead stitch 153 behind the first bead 116A and up through a center of the bead dropout section 126. Then the hairdresser continues around the head of the client placing one or more weft stitches 155 between each bead 116, securing only the wefts 140, 152. After the wefts 140, 152 are secured with the one or more stitches 155, a first side bead stitch 157 is placed on the side of the next bead 116, a bead stitch 159 is then placed behind the bead 116 and through the center of the dropout 126, and then a second side bead stitch 161 is placed on an opposite side of the bead 116. In one embodiment, the side stitches 157, 161 on the beads 116 may be slightly angled in. The hairdresser then repeats this process until reaching a last bead on the opposite side of the client's head. It should be noted that the stitching occurs by inserting the needle behind the wefts 140, 152 from top to bottom and bringing the hook 130 and the thread 154 through the loop created by the thread 154.

As the hairdresser repeats the process, the support hand (i.e., non-stitching hand) can feel each coming bead 116 to determine the placement of each stitch. The support hand may also prevent hairs from getting in the stitches. Further, the horizontal clips 146 that are being removed may be placed below the stitches to add securement. There should be a cross thread stitch 156 running parallel with the top weft 152.

At the last bead, the hairdresser, goes behind the last bead, takes the vertical clip 148 out, and places it horizontally to help secure the wefts 140, 152. Then the hairdresser may place multiple stitches (e.g., two to three stitches in front of the last bead), similar to the first bead 116A on the other side of the head, and three back stitches placed. The first back stitch is behind the last bead and then a double not. This will be performed two more times to create a secure knot on the wefts 140, 152. While multiple knots are shown, it will be appreciated that more or less knots may be used.

The hairdresser then removes the clips 146 and 148 and checks the cross stitching 156 to ensure that there is no looping of the client's natural hair underneath. If there is looping, the hair may be pulled out by hand or with a comb.

Figure 12:
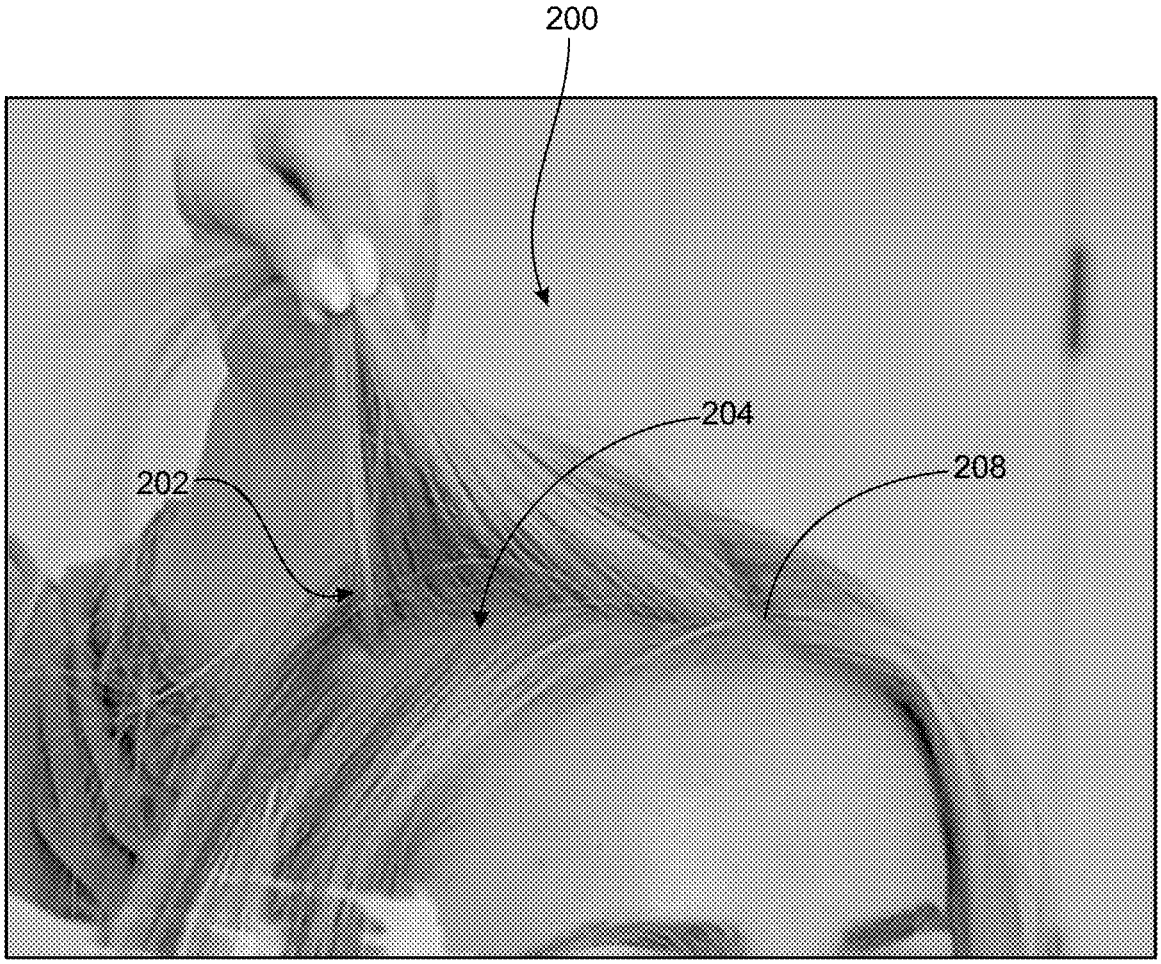
FIG. 12 illustrates sectioning checkpoints on a head of a client at a second section.
Figure 13:
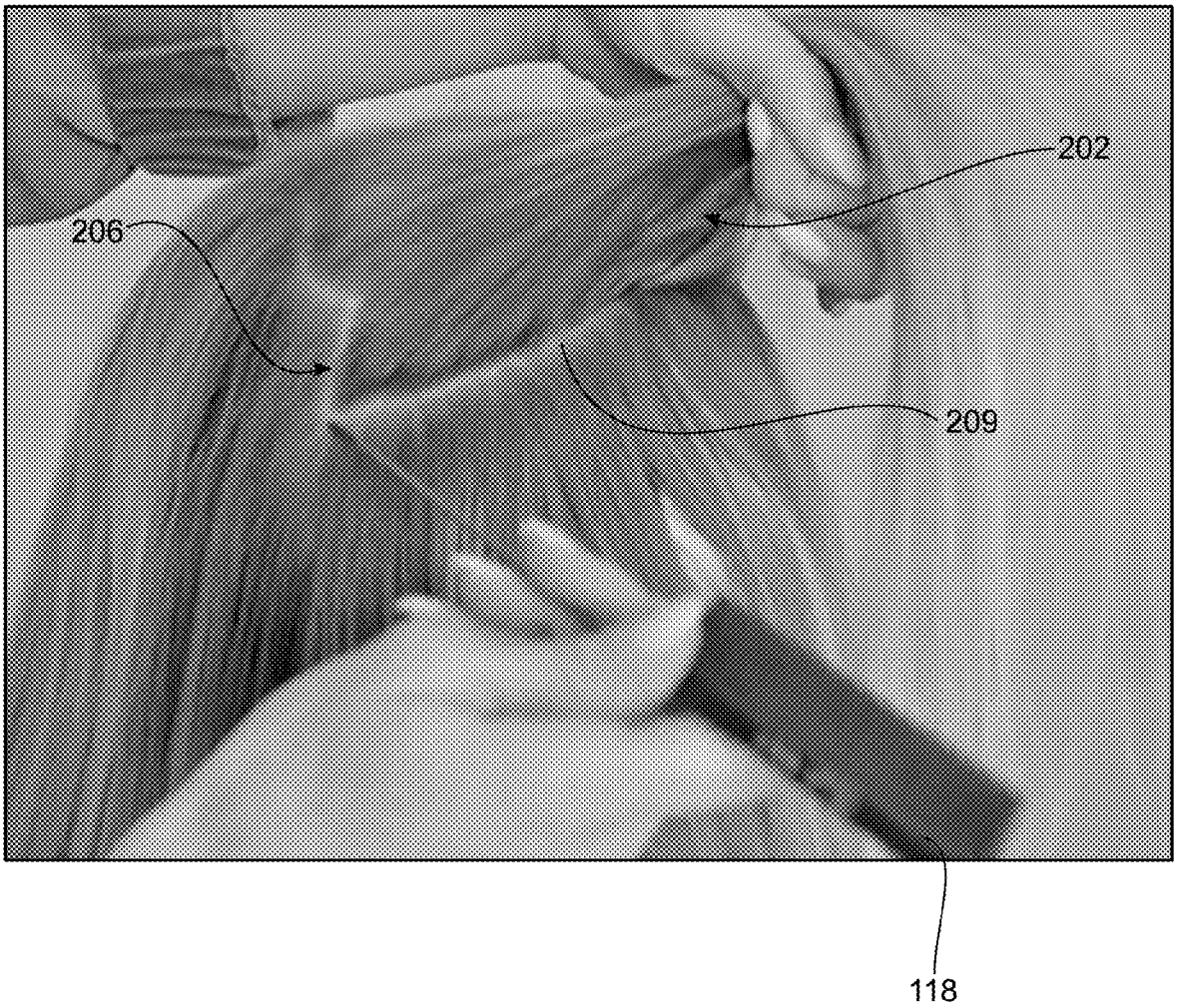
FIG. 13 illustrates a second checkpoint on a head of a client at a second section.

As shown in FIGS. 12-13, in one embodiment, a method of placing hair extensions on a client 200 at a second section 202 comprises sectioning, beading, securing, and stitching. Sectioning begins by performing a second section three point check. First, if the client has good density on top, the hairdresser should stay away from rounding the parietal ridge. A first check point 204 is for making sure that there is coverage on the top. The parietal ridge is where the head starts to round. If the client has a decent density on top, the hairdresser can round it just a little bit. If they do not, that is going to be the point that should not cross over, because as their hair splits where the parietal ridge starts to round, the extensions will be exposed. Accordingly, the first thing the hairdresser does is check the hairline to determine where to start the second section 202.

A second checkpoint 206 is the crown of the head. Everybody's crown splits on the back of the head. The hairdresser determines the location of the crown split on the client by splitting the hair on the back of the head. Although, all crown splits are on the back of the head, the location of the actual split will vary from client to client. The extensions should be placed below where the crown splits to prevent the extensions from being exposed. In one embodiment, the extensions are placed about one inch below where that crown splits.

Lastly, the third checkpoint 208 is going to be off of the client's part. This checkpoint may change depending on the client's typical part. For example, the weft may come up higher when a client has a deep side part. In particular, the u-shape parting may not be equal around the head and will be higher on one side than the other. Alternatively, if the client doesn't have a part and moves the hair from one side of the head to the other, the hairdresser determines from the client how far the hair is flipped over on the right and on the left. Knowing how far the client flips their hair on both sides of the head defines the new part lines where to start for the third checkpoint.

After the location of the second section 202 is determined, the natural hair of the client may be sectioned to create a second bottom row 209 to prepare for bead placement. If the client has fine hair, in one embodiment, the second section 202 may receive a 2 mm bead. Many women have fine hair on the side of their heads which may require smaller beads, such as the 2 mm bead. The thicker hair around the rest of the head may use larger beads, such as the 3 mm bead.

Figure 14:
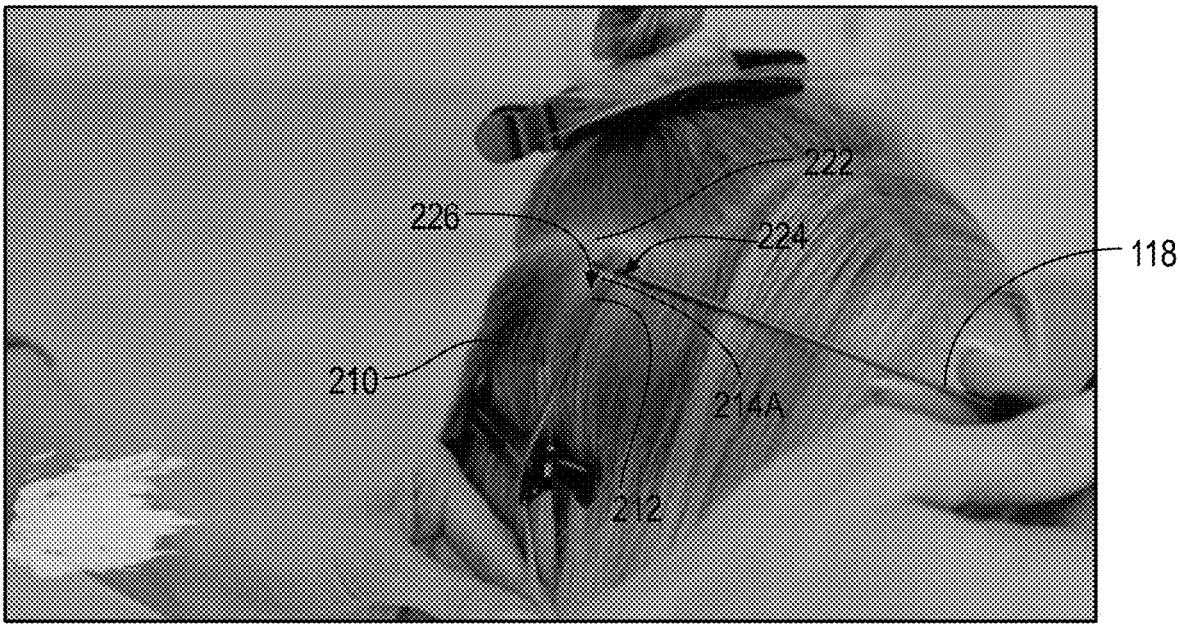
FIG. 14 illustrates bead placement and a flexible groove at a second section.

Creating the second dropout section 210 for the second section 202 is similar to that described above for the first section 108. In particular, the hair separator 118, or other measuring device may measure the sectioned hair (i.e., separated hair) at a depth of, for example, ⅜" to create the second dropout 210. As shown in FIG. 14, the second dropout 210 will then be sectioned into second bead dropout sections 212. In one embodiment, the second bead dropout sections 212 may have a width of ⅝". The beads 214 may then be threaded onto each of the second bead dropout sections 212 using the bead threader 132. The beads 214 should be crimped onto the hair so as to create a second flexible groove 216 under each of the sections of the second dropout 212. The bead 214 may be crimped, in some embodiments, ⅓ on base to create the second flexible groove 216. The beads 214 may then be placed and crimped on each ⅝" section, and the process is continued around the head of the client. It will be appreciated that the first and the last bead of the second section 202 may be offset to allow more room to stitch.

Figure 15:
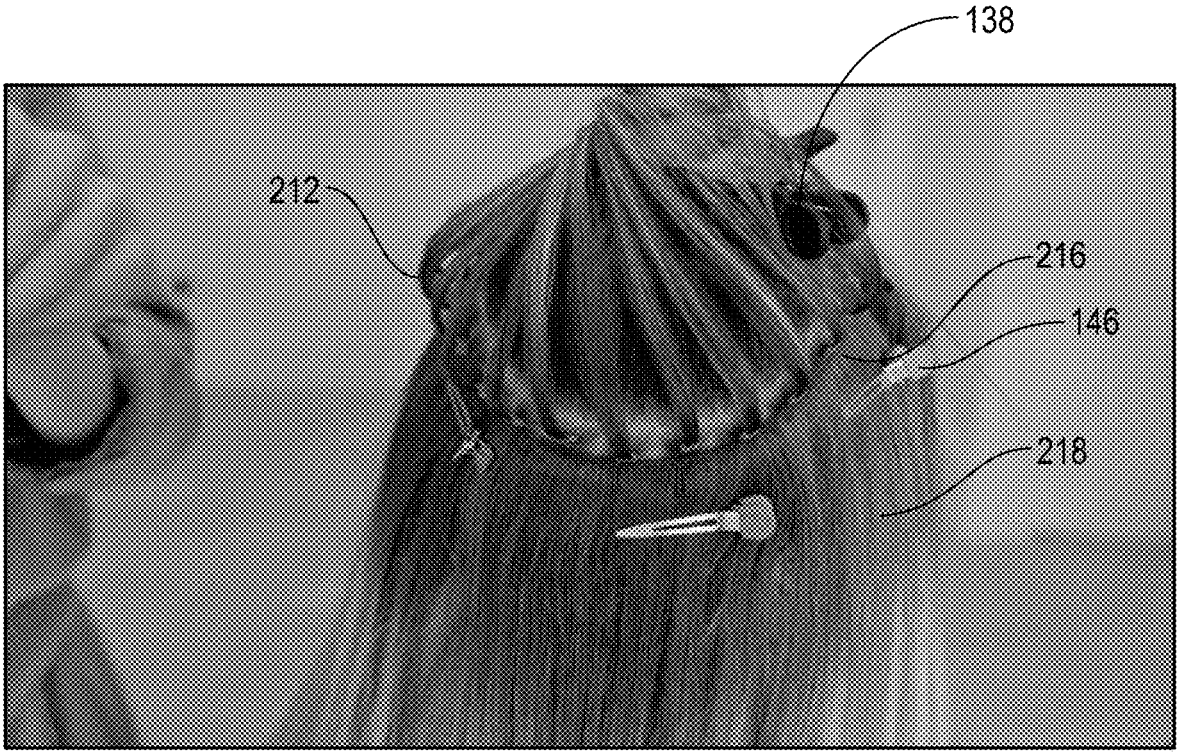
FIG. 15 illustrates a bottom weft coupled to a user at a second section.

As shown in FIG. 15, with the bead 214 being placed in the second section 202, a second bottom weft 218 may be placed underneath the beads in the second flexible grooves 216. The second bead dropout sections 212, created by the beads 214, may be pulled up and clamped to the top of the client's head with the top clip 138. The second bottom weft 218 may then be placed underneath the beads 214 in the second flexible grooves 216. In particular, as discussed above with respect to the bottom weft 140, the second bottom weft 218 may be placed in the second flexible grooves 216 such that a top end of the weft 218 is positioned between the beads 216 and the scalp or natural hair when the dropout sections 212 are let down. The second bottom weft

218 may then be secured to the client by placing the vertical and horizontal clips 146, 148 around the head of the client. In particular, horizontal and vertical clips 146, 148 are placed on the edges. In one embodiment, the edges of the second section bottom weft 218 may be folded over and clamped to the client at the crease of the fold. In some embodiments, additional wefts may be placed on the bottom row 209 of the second section 202.

It should be noted that if the client has fine hair, at least three secondary bottom wefts may be attached to the client. To apply these wefts for client's with fine hair, the hairdresser takes two wefts and places them at the center of the back of the client's head. Then the hairdresser wraps the corners at the face of the client and uses the vertical clips. The last weft is then centered in the middle of the back of the client's head.

Once the second bottom wefts are secure, the clamped dropout section may be released, allowing each individual dropout section to fall down. A second top weft 220 (shown in FIG. 17) on a second top row 222 of the second section 202 should be placed on the client with more slack than the second bottom wefts 218 on the second section 202. Further, it will be appreciated that one or more wefts may be placed on the top row 222. If there are additional second top wefts placed, they will be placed and secured using the same horizontal and vertical clips 146, 148 that secure the other top wefts.

Figure 16:
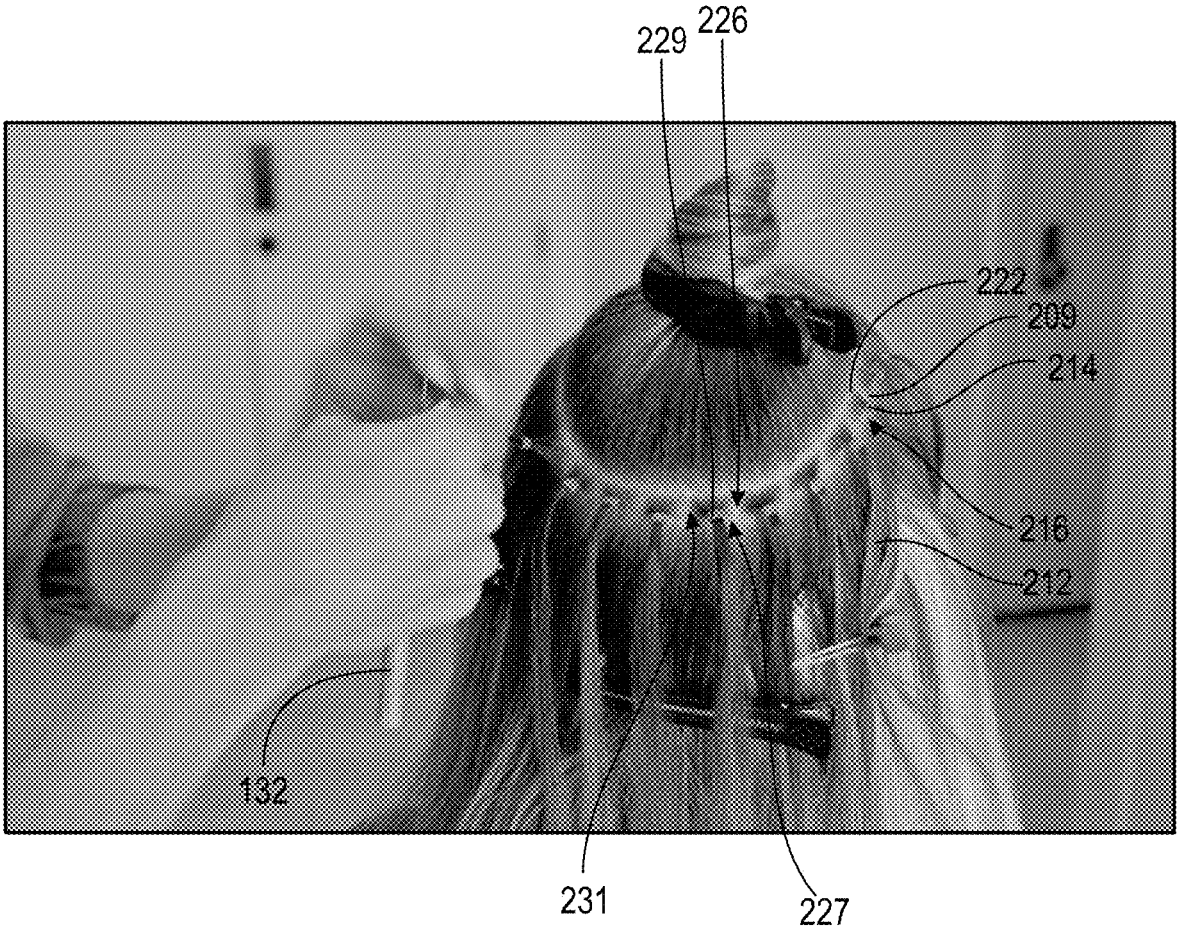
FIG. 16 illustrates bead placement and attachment at a second section.
Figure 17:
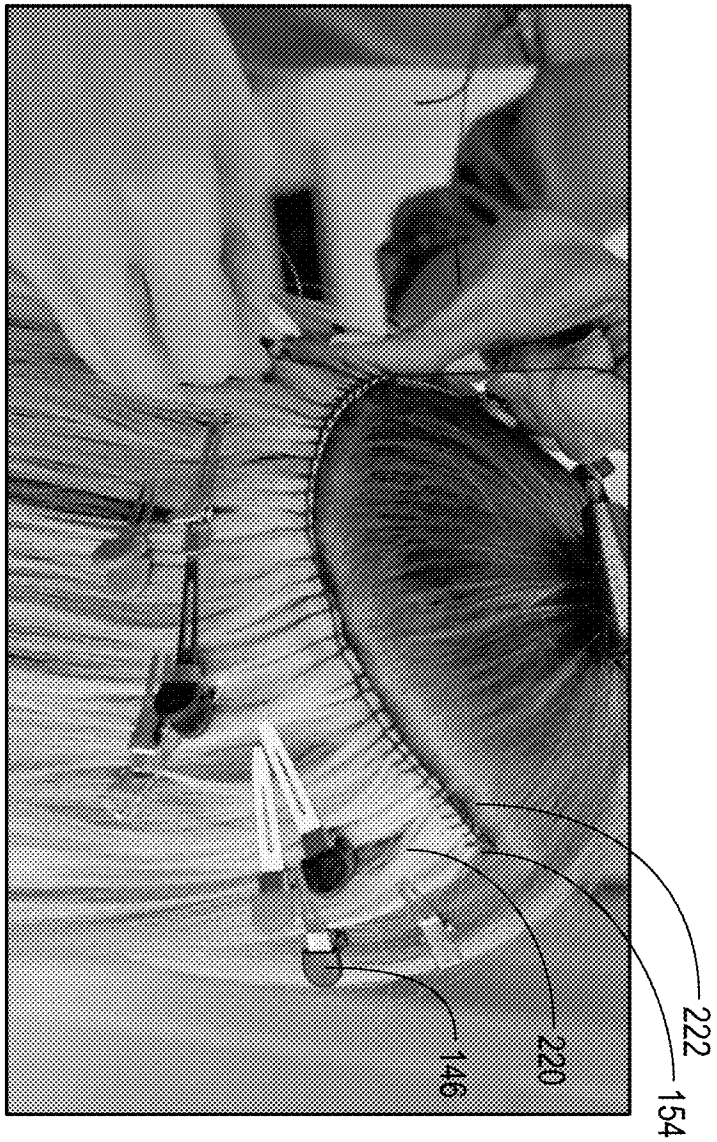
FIG. 17 illustrates a top weft and a bottom weft coupled to a client at a second section.

As shown in FIGS. 16-17, the wefts 218, 220 of the second section 202 may be attached to the client using the thread 154 and hook 130. In particular, FIG. 16 illustrates placement of stitches for the second section as discussed below. The wefts 218, 220 may then be stitched in by using the same pattern and method as used for attaching the wefts 140, 152 onto the first section 108. In particular, the hairdresser may make the first knot on an inside edge 224 of a first bead 214A of the second section 202. If the corner was folded over, then it may be laid flat on the beads 214 towards the back of the head and secured with multiple stitches. Then the thread is tied off twice and the tail is cutoff. The hairdresser makes multiple reinforcement stitches (e.g., two to three) on an outside edge 226 of the first bead 214A opposite the inside edge 224, of the first bead 214A, ensuring that the wefts 218, 220 lay flat against the client's scalp. Once stitches are placed on the outside edge 226 of the first bead 214A, the hairdresser then places multiple stitches behind the first bead 214A and up through a center of the second bead dropout section 212. Then the hairdresser continues around the head of the client placing one or more weft stitches 226 between each bead 214, securing only the wefts 218, 220. After the one or more weft stitches 226 on only the wefts, a first side bead stitch 227 is placed on the side of the next bead 214, a bead stitch 229 is then placed behind the bead and through the center of the dropout 212, and then a second side bead stitch 231 is placed on an opposite side of the bead 214. The vertical clip 148 may then be placed horizontally to help secure the wefts 218, 220.

To finish the stitching, the hairdresser places a double knot behind a last bead 214B of the second section 202. For example, the hairdresser takes the hook 130 and thread 154 behind the last bead 214B, through towards herself/himself two times. This may knot may be performed two more times through only the second bottom and top wefts 218, 220.

It should be noted that if a client wants a third section, it may be placed between the first and second sections 108, 202. The third section may receive a set of wefts in a similar manner as described above for the first and second sections 108, 202.

In the prior art, clients often worry about tension and weight that comes from hair extensions. However, the method of attaching hair extensions described herein fixes tension by creating the flexible groove and the weight issue by placing fewer wefts in a bottom and top position. Ultimately, this can result in more comfort when wearing hair extensions and less damage to hair and scalp.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A method of attaching hair extensions comprising:

determining a location to section a client's natural hair;

using a rod to section a bottom parting line from a portion of natural hair of a client and creating the bottom parting line in a horseshoe pattern;

using the rod to section a top parting line from another portion of natural hair above the bottom parting line and creating the horseshoe pattern;

creating a dropout section between the bottom parting line and the top parting line;

measuring bead dropout sections with the rod, the rod comprising a first measurement for measuring a width of a bead dropout section and a second measurement for measuring a depth of the dropout section;

placing multiple beads away from a scalp to create a flexible groove below each of the bead dropout sections on the bottom parting line, wherein the multiple beads comprise a first bead, a last bead and a plurality of middle beads disposed between the first and last bead and each bead comprises opposing inside and outside edges;

clamping a bead on each of the bead dropout sections;

securing a bottom weft on a bottom side of the dropout section adjacent the bottom parting line within the flexible groove via a plurality of haft clips;

securing a top weft on a top side of the dropout section adjacent the top parting line via the plurality of hair cups; and using a stitching pattern to conceal the beads and to secure the bottom weft and the top weft to the client, the stitching pattern comprising;

placing at least two reinforcement stitches adjacent the outside edge of the first bead, then placing a bead stitch behind thereof, placing one or more weft stitches, securing only the wefts, between the first bead and the middle bead positioned adjacent the first bead, for each of the middle beads placing a first side bead stitch on the bottom weft and the top weft adjacent the outside edge thereof of, then placing a bead stitch behind each middle bead and up through a center of the respective bead dropout section, then placing a second side bead stitch on the bottom weft and the top weft adjacent the inside of each middle bead from the first side bead stitch, and then placing a weft stitch securing only the wefts, between each of the middle beads, for the last bead, placing at least two reinforcement stitches adjacent the outside edge thereof:

wherein each stitch is created by inserting a needle behind the at least one bottom weft and at least one top weft and bringing the needle and a thread through a loop created by the thread.

2. The method of attaching hair extensions of claim 1, wherein the rod is a tail section of a tail comb.

3. The method of attaching hair extensions of claim 1, wherein the bottom weft is a hand tied weft and the top weft is a hand tied weft.

4. The method of claim 1, wherein a top portion of the bottom weft is positioned between the bead and the scalp when the drop out sections are let down.

5. The method of attaching hair extensions of claim 1, wherein securing the bottom weft and top weft comprises fastening the plurality of hairclips in a vertical and horizontal orientation along a length of the weft.

6. The method of attaching hair extensions of claim 1, further comprising sectioning a second section of natural hair.

7. The method of attaching hair extensions of claim 6, wherein sectioning the second section comprises checking a first checkpoint, a second checkpoint, and a third checkpoint.

8. The method of attaching hair extensions of claim 1, further comprising lifting the wefts, exposing the bottom parting line, and removing hairs unintentionally looped into the stitching.

9. The method of attaching hair extensions of claim 1, further comprising sectioning a third section of natural hair to receive hair extensions.

* * * * *